US008404320B1

(12) United States Patent
Potoroka, Sr.

(10) Patent No.: US 8,404,320 B1
(45) Date of Patent: Mar. 26, 2013

(54) METHOD, APPARATUS AND KIT FOR ATTACHING ARTIFICIAL FLOWERS TO NON-BLOOMING LIVE VEGETATION TO SIMULATE BLOOMING THEREOF

(76) Inventor: Walter Potoroka, Sr., Oakland, MI (US)

( * ) Notice: Subject to any disclaimer, the term of this patent is extended or adjusted under 35 U.S.C. 154(b) by 1055 days.

(21) Appl. No.: 10/234,897

(22) Filed: Sep. 4, 2002

Related U.S. Application Data

(60) Provisional application No. 60/317,381, filed on Sep. 6, 2001.

(51) Int. Cl.
*A01G 5/04* (2006.01)

(52) U.S. Cl. ..... 428/21; 428/24; 47/55; 47/41.01; 47/41.11; 47/41.15

(58) Field of Classification Search ..... 47/55, 41.01, 47/41.11, 41.15; 428/17–27
See application file for complete search history.

(56) References Cited

U.S. PATENT DOCUMENTS

| | | | | |
|---|---|---|---|---|
| 2,514,177 A | | 7/1950 | Brown, Jr. | 41/13 |
| 2,881,545 A | | 4/1959 | Decamp | 41/13 |
| 2,984,036 A | | 5/1961 | Adler, Jr. | 41/10 |
| 3,137,610 A | | 5/1961 | Flynn | 161/30 |
| 3,041,766 A | * | 7/1962 | DeCamp | 428/24 |
| 3,050,619 A | | 8/1962 | Abramson | 240/10 |
| 3,309,258 A | | 3/1967 | Gallo | 161/26 |
| 3,452,476 A | | 3/1967 | Kise | 47/55 |
| 3,870,586 A | * | 3/1975 | Backus | 428/24 |
| 4,585,677 A | * | 4/1986 | Hwang et al. | 428/26 |
| 4,600,612 A | | 7/1986 | Litwin et al. | 428/23 |
| 4,816,301 A | | 3/1989 | Weitz | 428/17 |
| 5,104,467 A | | 4/1992 | Johnson | 156/61 |
| 5,221,565 A | | 6/1993 | Johnson | 428/17 |
| 5,733,612 A | | 3/1998 | Garry | 428/23 |
| 6,017,596 A | | 1/2000 | Deraney | 428/27 |
| 6,058,648 A | * | 5/2000 | Kingston | 47/41.15 |

FOREIGN PATENT DOCUMENTS

DE 3543651 A * 6/1987

OTHER PUBLICATIONS

Haab, S., Making Mini-Books, Jun. 2002, Klutz, Inc.*

* cited by examiner

*Primary Examiner* — Elizabeth Cole
(74) *Attorney, Agent, or Firm* — Burgess Law Office, PLLC

(57) ABSTRACT

Per TITLE OF INVENTION, there is disclosed methods, apparatus and kits for attaching artificial flowers (particularly flowers formed with means such a passage to frictionally receive an artificial stem in assembly of an artificial flower plant) to a non-blooming live vegetation stem or branch that is not frictionally receivable in the flower passage, whereby a substitute stem that is frictionally receivable in the flower passage may be custom-formed from various commercially-available wire-like elements to provide (a) single or double free-end twist tie means for attachment of such single flowers to such live stems or branches or (b) means for attaching a plurality of such flowers to a non-blooming live bush in the manner of a string of Christmas tree lights.

4 Claims, 1 Drawing Sheet

PRIOR ART

METHOD, APPARATUS AND KIT FOR ATTACHING ARTIFICIAL FLOWERS TO NON-BLOOMING LIVE VEGETATION TO SIMULATE BLOOMING THEREOF

CROSS-REFERENCE TO RELATED APPLICATIONS

The invention of the present application is an improvement over the invention in Applicant's copending utility patent application Ser. No. 09/706,316, filed Nov. 4, 2000, this Application being based upon provisional patent application Ser. No. 60/317,381, filed Sep. 6, 2001.

STATEMENT REGARDING FEDERALLY SPONSORED RESEARCH AND DEVELOPMENT

Not Applicable

REFERENCE TO A MICROFICHE APPENDIX

Not Applicable

BACKGROUND OF THE INVENTION

1. Field of the Invention

This invention relates generally to methods, apparatus and kits for attachment of artificial flowers to non-blooming live vegetation having stems, branches or leaves, to simulate blooming thereof, and more particularly to kits comprising (a) one or more artificial flowers having a passage to frictionally receive an artificial stem in assembly of an artificial flower plant and (b), as a kit component, instructions for, and/or a sample assembly of, use of commercially-available materials, which may or may not be included in the kit, to custom form means for such attachment of such artificial flowers, whereby any artificial flower having such a stem passage can be used for both (1) assembly of prior art artificial flower plants and (2) assembly of such kits to supply a new market for such flowers.

Use of artificial flowers with live vegetation is taught in U.S. patents, such as Brown U.S. Pat. No. 2,514,177 and Kingston U.S. Pat. No. 6,058,648.

Descriptive terms found in advertising of artificial flower plants are vibrant color, year 'round, all weather, never need watering, lifelike, indoors and out, gorgeous, absolutely free, not at all fussy about sun, keeps folks guessing, stay as lovely as the day you 'planted' them, pretty indoors too, etc. Most of the above, along with other advantages, also apply to use of artificial flowers on non-blooming live vegetation.

U.S. Pat. No. 6,017,596 (Deraney) and U.S. Pat. No. 6,058,648 (Kingston) both refer and add to "the myriad of designs encompassed by the crowded prior art which have been developed for the fulfillment of countless objectives and requirements," thereby emphasizing the principle of patentability, even in crowded arts, as in the U.S. patents referenced below, over which the invention is also distinguished.

Patentability of kits for various uses of artificial flowers is evidenced by Garry U.S. Pat. No. 5,733,612, Litwin et al U.S. Pat. No. 4,600,612 and Deraney U.S. Pat. No. 6,017,596. It is also important to note that Litwin relates to a floral arrangement system or method that includes, as an important invention component, instructional printed matter indicium combined with structural artificial flower components. That is, while printed matter, by itself, is not patentable subject matter, a novel combination including a printed matter component is patentable subject matter.

Flynn U.S. Pat. No. 3,137,610 entitled "Artificial Flower Construction" is distinguished from the present invention in that it teaches (at column 1, line 65 to column 2, line 20) a kit including a "special holding means for securing all of those components" (flower and leaf parts) "in nested relation to one another and also to a branch or stem 2. For this purpose, I employ a U-shaped retainer element . . . . By means of this arrangement, I am enabled to secure all of the elements by one holding element . . . . "

However, whatever the specific artificial flower structure, it is important to this invention that (1) the flower parts be securely held together when the flower is separated from an artificial or live stem, as in kits of this invention, and (2) the same artificial flowers used to assemble artificial flower plants can be used to simulate blooming of non-blooming live vegetation, neither of which is true of or contemplated by Flynn above. Separation of the flower parts is, in most cases, destructive of the flower because it cannot be easily properly reassembled to as-manufactured condition, and multiple uses is always cost effective.

Other U.S. patent prior art, over which the invention is also distinguished, are Decamp U.S. Pat. No. 3,041,766, Gallo U.S. Pat. No. 3,309,258, Weitz U.S. Pat. No. 4,816,301, Abramson U.S. Pat. No. 3,050,619, Kise U.S. Pat. No. 3,452,476, Adler, Jr. U.S. Pat. No. 2,984,036 and Decamp U.S. Pat. No. 2,881,545.

While the prior art teaches use of artificial flowers with live vegetation, and even though artificial flower plant displays in nurseries, craft stores, etc., have proliferated significantly, simulated blooming of live vegetation is not seen practiced, or in any way even suggested, throughout the industry, which most likely explains the lack of suitable flower attachment means, such as the substitute stem/flower stem passage means taught herein, and other means taught in the above-related copending utility Application.

That is, kits are not available for that purpose, artificial flowers with a stem passage for frictionally receiving stems used for assembly of artificial flower plants are not sold per se (without, or separate from, not-needed artificial stems or branches and leaves) for conversion of non-blooming live vegetation and such products or simulated blooming of live vegetation are not advertised. In fact, a prominent gardening expert stated that the only option for blooming gardens in the shade is to plant shade-blooming vegetation, which is very limited to hostas or other foliage plants, or not always successful.

However, artificial flowers, advertised as "breathtakingly lifelike," attached to non-blooming live vegetation, even in deep shade, do provide instant beauty, wherever and whenever desired, and even under less than ideal conditions. Obviously, since artificial flower plants are so successfully marketed for use outdoors, artificial flowers per se, (without artificial stems, branches or leaves) to be attached to indoor and outdoor live vegetation should be equally marketable.

Since the predominant artificial flower is formed with a passage to frictionally receive a artificial stem, and because the flower parts do not separate when the flower is removed from the stem, the flower can be moved from stem to stem, live or artificial, or included in a kit without stems.

For cost, manufacturing, inventory, new-market windfall profits and other reasons, it is desirable and important that any artificial flower structure be usable, as is, both for traditional assembly of artificial flower plants and for new-market attachment to live vegetation, to simulate blooming thereof.

However, an important problem with such a flower passage, which can also frictionally receive a live stem, is that many live stems and branches are either too large, too small or otherwise not frictionally receivable in the passage, or not located where it is desired to attach the flower.

Obviously, a problem with attachment of artificial flowers having a portion to be inserted into a live stem passage (as in Kingston) is that hollow live stems (like a tulip) having such passages are limited, since almost all live stems are solid, rather than hollow.

For the above reasons, copending U.S. patent application Ser. No. 09/706,316 teaches flower attaching means supplemental to the flower passage, one of which is the well-known commercially-available prior art wire twist tie, for attaching a flower to a live stem or branch not receivable in the flower passage. The instant invention relates to further improved flower attaching means, including a wire custom-made stem substitute frictionally insertable into a through or a dead-end flower passage of varying dimensions, to provide a twist tie having a single or two free ends.

BRIEF SUMMARY OF THE INVENTION

Some of the various separate objectives and advantages of the invention are to provide:

(1) A kit for attaching artificial flowers to non-blooming live vegetation to simulate blooming thereof, the kit comprising one or more flowers with a stem passage and an elongated wire-like element or means from, or along which, flower attaching means can be easily custom-formed where desired for applying, to such non-blooming live vegetation, a single flower or a string of the flowers in the manner of Christmas tree lights.

(2) A method of, or a kit for, providing flower attaching means from a wire-like support element simply by forming therein a loop substitute stem that is frictionally insertable into and removable from the passage formed in the flower to receive an artificial stem in assembly of artificial flower plants.

(3) A kit comprising, as a kit component, in addition to a flower having a stem passage, instructions for purchase and/or use of suitable commercially-available wire element means, from which to form wire-loop stem substitutes, and/or a sample flower/loop stem assembly for the kit user to duplicate.

(4) A kit enabling a method whereby a reel or spool of wire can be cut into shorter lengths to form individual single or double-leg twist ties by forming a loop substitute stem at one end or intermediate the ends thereof, leaving one or two free ends extending from a flower passage to be twisted around a live stem not frictionally insertable into the passage.

(5) A kit including, as a component thereof, instructions and/or a sample of commercially-available items, such as bulk plastic-coated or cloth-coated wire, or chenille-tufted smoking pipe cleaner-type craft items, assembled to provide tie attachment means.

(6) A kit wherein the commercially-available component included therein comprises a reel or spool of wire such as, or the equivalent of, coated 22, 24 or 26 GA ¼ LB gardener wire, coated twist tie wire, 32 GA Panacea brand spooled cloth-wrapped flower arranging wire or chenille-tufted smoking pipe cleaner-type craft items.

Other objectives and advantages of this invention will become apparent from the following description taken in conjunction with the accompanying drawings wherein are set forth, by way of illustration and non-restrictive example, certain embodiments of the invention, and in which corresponding parts are identified by the same reference numerals in the several views.

Commercially-available ties are specifically designed for twisting two free ends thereof, as for closure of plastic bags, etc., the wire core of the tie being normally too frail to secure artificial flowers by one free end thereof. Also, important cost effectiveness requires that maximum use be made of inexpensive commercially available items, which also enable craft do-it-yourself capability.

Further, it is obviously desirable that a beautiful lifelike artificial flower be attached to the live vegetation in the same manner as it is attached to the artificial stem, as by frictional insertion of the live stem into the flower passage. Since that is not always possible, means according to the invention are provided.

DETAILED DESCRIPTION OF THE INVENTION

Figure 1:
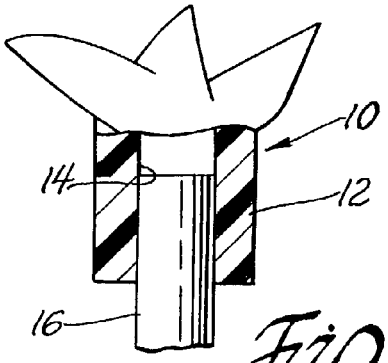
FIG. 1 is a fragmentary enlarged elevational view, partly in cross section, illustrating a prevalent prior art structure for attaching an artificial flower to an artificial or a live stem.

Referring now specifically to FIG. 1 of the drawings, a prevalent prior art artificial flower plant structure comprises an artificial flower 10 (otherwise of any design or structure) having a molded plastic base 12 formed with a passage 14 frictionally receiving a stem 16, which can be either an artificial stem in assembly of an artificial flower plant or a like-size live stem in conversion of non-blooming live vegetation to simulate blooming thereof.

The invention is particularly suited for artificial flowers formed with passage 14 in a manner such that (unlike Flynn above) the flower parts remain securely assembled when the flower is used to assemble a conversion kit without a stem 16 in passage 14.

Further, passage 14 provides a first means always available for attaching flower 10 to non-blooming live vegetation, simply by inserting a same-size live stem or branch frictionally receivable in the passage. The invention provides additional substitute-stem means (using commercially-available wire) for attaching a flower to a live stem or branch that is not frictionally receivable in the passage, anywhere on the live vegetation.

In FIGS. 2-7, the additional attaching means is provided by custom forming a substitute stem from a commercially-available flower-arranging or other wire element means 18 (or a pipe cleaner-type wire 37) such as, or equivalent to, that described in above objective (16) of the invention.

Figure 2:
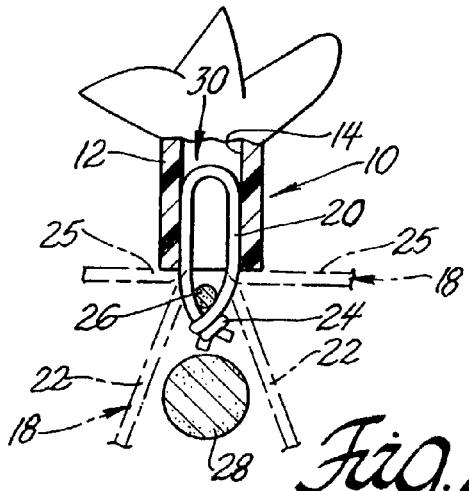
FIG. 2 is a view similar to FIG. 1 illustrating one embodiment of the invention.

In FIG. 2, the diameter of the cylindrical passage 14 in plastic base 12 is typically about 1/16-1/8 inch and the substitute stem is a single loop 20 formed in wire element 18.

Figure 4:
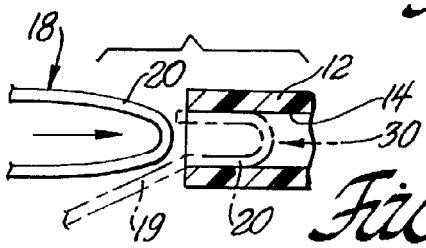
FIG. 4 is a fragmentary portion of FIG. 2 illustrating a principle involved in the invention.

Referring to FIG. 4, it is believed that insertion of wire loop substitute stem 20 into passage 14 of flexible plastic base 12 conveniently contributes frictional engagement therebetween, perhaps by the resistance of flexible base 12 and loop 20 to change from their pre-insertion free state shapes when loop 20 is pushed or squeezed into passage 14.

Figure 3:
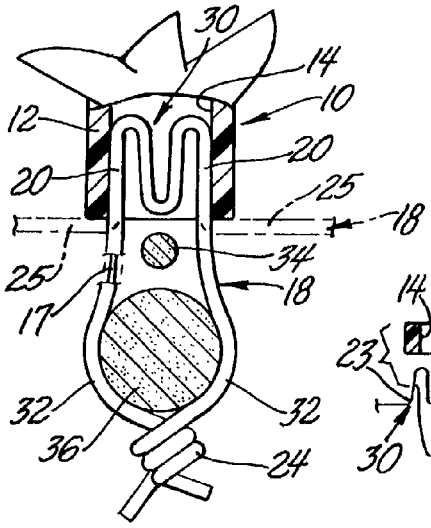
FIG. 3 is a view similar to FIG. 2 illustrating a second embodiment of the invention.

As shown in FIG. 2, the wire element 18, which may be, or the functional equivalent of, a plastic-coated or painted metal wire 17, as shown in FIG. 3, may be cut for insertion into passage 14, before or after formation of loop 20, to provide tie free ends 22 to be twisted, as at 24, for attachment of flower 10 to a live stem or branch 26 that is too small to be frictionally inserted into passage 14, or for similar attachment to live branch 28 that is too large for insertion into passage 14.

In FIG. 3, since the diameter of passage 14 is larger than in FIG. 2, substitute stem 30 comprises two adjacent loops 20, for insertion, as in FIG. 4, for frictional engagement thereof in larger passage 14. The wire free ends 32 can be cut to any length required, as in FIG. 2, for attachment of flower 10 to live branches 34 and 36 that are too small and too large, respectively, for frictional insertion into passage 14.

Figure 6:
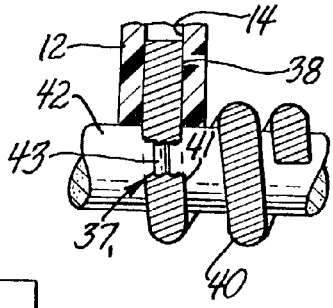
FIG. 6 is a view similar to FIG. 2 illustrating a fourth embodiment of the invention.

Also, as shown by broken lines in FIG. 4, loop 20 may have only one free end 19 extending from passage 14 to provide a one free-end tie to be wrapped around a live stem or branch 42, in the manner of free end 40 of pipe cleaner tie 37 shown in FIG. 6.

Figure 5:
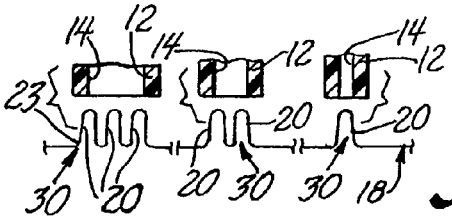
FIG. 5 is a diagramatic view illustrating a third embodiment of the invention.
Figure 8:
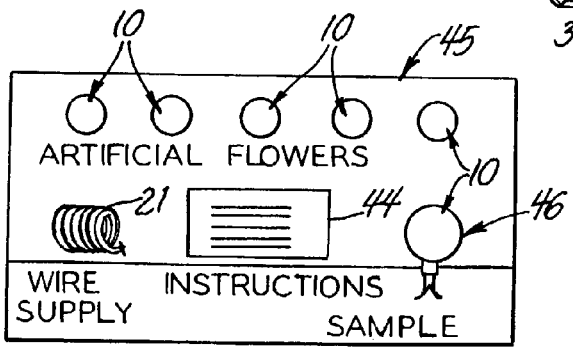
FIG. 8 is a schematic illustration of only one of various possible kit embodiments of the invention.

FIG. 5 illustrates the important advantage and versatility of the invention, whereby an elongated wire 18 from a spool thereof (such as wire spool 21 that may be contained in the kit 45 of FIG. 8 or purchased separately) can be formed (wherever needed, for conversion of a non-blooming larger live plant or bush, in the manner of a string of Christmas tree lights, to simulate blooming thereof) to provide a single (FIG. 2), double (FIG. 3) or even a triple (as shown at 23 of FIG. 5) loop 20 stem substitute, depending upon the passage 14 dimension.

Figure 7:
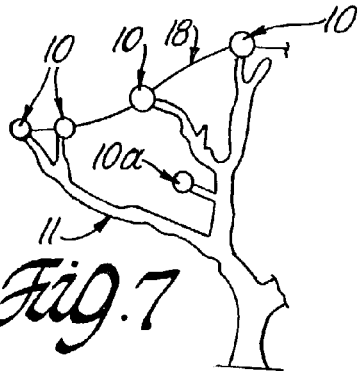
FIG. 7 is an elevational diagramatic view illustrating use of a combination of the embodiments of the invention shown in FIG. 2, 3 or 6 and in FIG. 5.

It is apparent from FIGS. 2-7 that single, double or triple, etc., loop substitute stems 30 may be cut from the wire 18 for single-flower 10*a* single or double free end twist tie attachment to a live vegetation bush or small tree 11, or left uncut, as represented by the broken-line laterally-extending wire portions 25 of FIGS. 2 and 3, for Christmas tree light-type attachment of a plurality of flowers 10 to live vegetation by elongated wire 18, as shown in FIG. 7, connecting a plurality of flowers 10.

FIG. 7 dramatically and vividly illustrates an artificial flower new market contemplated by the invention of potentially considerable interest to all nurseries. That is, a live-vegetation nursery could, in addition to separate sale of various kits embodying the invention, of which kit 43 of FIG. 8 is just one example, promote sales of never-bloom or short-bloom live vegetation (bushes, vines, etc.) by including, at no or little additional cost, to the consumer, kits for attaching artificial flowers thereto. Also, a nursery could advertise and market a kit embodying the invention comprising (1) live vegetation, per se, to be planted and (2) artificial flowers with means for attaching the same to such live vegetation during non-blooming periods. The content of a kit embodying the substitute stem of the invention is variable.

It has been further discovered that commercially-available smoking pipe cleaners 37 (or similar craft store items) comprising a chenille 41 tufted wire 43 are frictionally receivable (a perfect fit) in flower passages 14.

FIG. 6 illustrates insertion of free end 38 of a pipe cleaner 37 (such as Item No. 3220 of The Chenille Kraft Company), into flower passage 14, like stem 16 of FIG. 1, with the single free end 41 thereof, which is long enough and more sturdy than one free end of a common twist tie, extending from the passage 14 being very easily, quickly and securely wrapped around, as at 40, most live branches, such as branch 42, which may be either too large or too small for frictional insertion into passage 14. Also, a flower 10 so attached is easily repositioned at any time for best appearance thereof on the bush 11, merely by bending the free end at 41.

Obviously, for larger passages 14, one or more loops 20, as in FIGS. 2 and 3, may be formed in the pipe cleaner 37, to provide single or double twist tie free ends 19, 22 or 32.

FIG. 8 illustrates schematically another embodiment of the invention comprising a more complete kit for converting non-blooming live vegetation to simulated blooming condition, the kit including one or more artificial flowers 10 having a stem passage, a spool 21 supply of wire 18 such as that referred to above, helpful instructions 44 (as an important kit component) for use of the wire to form substitute stems 30 and a one-flower assembled sample flower/substitute stem 46 to be duplicated by the kit consumer. However, since suitable wire 18 is commercially separately available, a kit embodying the invention could include only a flower 10 and, in or on the kit package instructions, as a kit component, explaining purchase and/or use of suitable wire by the consumer.

The above copending U.S. patent application teaches various flower attaching means, including integral and separate pin and/or clip adapter means, as well as twist tie means, for assembly of kits for conversion of non-blooming live vegetation to simulated blooming condition. This invention contemplates attachment of artificial flowers having a stem passage by custom forming substitute stems from materials such as, but not limited to, commercially-available craft or flower-arranging wire, since any otherwise suitable wire, coated or not, can be used to form the easily-inserted and easily-removed loop substitute stems.

It is intended and should be understood that a kit embodying the invention may comprise one or more artificial flowers having a passage to frictionally receive an artificial stem, a live stem or the wire substitute stem described herein, so that flowers used for assembly of artificial flower plants can also be used as components of a kit to convert non-blooming live vegetation to simulated blooming thereof.

Although the invention and certain embodiments thereof have been disclosed and described in such clear and concise terms as to enable persons skilled in the art to practice the same, including methods, apparatus and kits for attaching artificial flowers for such conversion of non-blooming live vegetation, it is understood that other embodiments and modifications may be possible within the scope of the invention, and that no limitations are intended, except as recited in the appended claims. For example, a kit is clearly within the scope of the invention, whether or not artificial plant parts, such as stems, branches or leaves, are included therein.

That is, while the invention has been described in connection with what is presently considered to be the most practical and preferred embodiment, it is to be understood that the invention is not to be limited to the disclosed embodiments but, on the contrary, is intended to cover various embodiments and equivalent arrangements included within the spirit and scope of the appended claims, which scope is to be accorded the broadest interpretation so as to encompass all such modifications and equivalent structures as is permitted under the law.

What I claim as my invention is:

1. A kit comprising:

a) an artificial flower assembly comprising:

a plurality of artificial flowers, each having a stem-receiving passage, a continuous wire stem portion formed into a series of loops, wherein each loop is frictionally inserted into a stem receiving passage of a flower, such that a single continuous wire has a plurality of flowers mounted thereon;

b) a plurality of artificial flowers, each having a stem-receiving passage;

c) a supply of wire;

d) instructions for forming said supply of wire into a series of loops, and inserting each loop into the stem-receiving passage of said artificial flowers, to form an artificial flower assembly like that of artificial flower assembly.

2. The kit of claim 1, wherein said wire is a chenille stem, a tufted pipe cleaner, 22-32 gauge gardener wire, or coated twist tie wire.

3. A kit comprising:

a) an artificial flower assembly comprising:

a plurality of artificial flowers having a stem-receiving passage, a continuous wire stem portion formed into a series of loops, wherein a loop is frictionally inserted into a stem-receiving passage of a flower, such that a single continuous wire has a plurality of flowers mounted thereon;

b) a plurality of artificial flowers having a stem-receiving passage;

c) a supply of wire;

d) instructions for forming said supply of wire into a series of loops, and inserting each loop into the stem-receiving passage of said artificial flowers, to form an artificial flower assembly like that of the artificial flower assembly.

4. The kit of claim 3, wherein said wire is a chenille stem, a tufted pipe cleaner, 22-32 gauge gardener wire, or coated twist tie wire.

* * * * *